US010954883B2

(12) United States Patent
Takagawa

(10) Patent No.: US 10,954,883 B2
(45) Date of Patent: Mar. 23, 2021

(54) WATER JACKET STRUCTURE

(71) Applicant: TOYOTA JIDOSHA KABUSHIKI KAISHA, Aichi-ken (JP)

(72) Inventor: Hajime Takagawa, Susono (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/373,559

(22) Filed: Apr. 2, 2019

(65) Prior Publication Data

US 2019/0345891 A1 Nov. 14, 2019

(30) Foreign Application Priority Data

May 9, 2018 (JP) ..... JP2018-090770

(51) Int. Cl.

| | |
|---|---|
| ***F02F 1/36*** | (2006.01) |
| ***F01P 3/02*** | (2006.01) |
| ***F02F 1/14*** | (2006.01) |
| ***F02F 7/00*** | (2006.01) |

(52) U.S. Cl.

CPC ..... *F02F 1/36* (2013.01); *F01P 3/02* (2013.01); *F02F 1/14* (2013.01); *F02F 7/00* (2013.01); *F01P 2003/028* (2013.01)

(58) Field of Classification Search

CPC combination set(s) only.
See application file for complete search history.

(56) References Cited

U.S. PATENT DOCUMENTS

| | | | | | |
|---|---|---|---|---|---|
| 2,710,602 | A * | 6/1955 | Maybach | F02F 1/40 | 123/41.76 |
| 3,491,731 | A * | 1/1970 | Herbert | F01P 3/14 | 123/41.82 R |
| 5,964,196 | A * | 10/1999 | Sigle | F02F 1/4214 | 123/193.5 |
| 2004/0173168 | A1 * | 9/2004 | Obermayer | F02F 1/40 | 123/41.31 |

FOREIGN PATENT DOCUMENTS

| | | | |
|---|---|---|---|
| DE | 10331918 | A1 | 2/2004 |
| JP | S56-120328 | U | 9/1981 |
| JP | H6-40336 | U | 5/1994 |
| JP | 2003-184643 | A | 7/2003 |
| JP | 2003184643 | A * | 7/2003 |
| JP | 2017-193971 | A | 10/2017 |

OTHER PUBLICATIONS

Extended European Search Report in EP Application No. 19165011.8, dated Oct. 7, 2019, 6pp.

* cited by examiner

*Primary Examiner* — Kevin A Lathers
(74) *Attorney, Agent, or Firm* — Hauptman Ham, LLP

(57) ABSTRACT

A water jacket structure includes: a lower water jacket that is provided inside a cylinder head installed at the top of a cylinder block; and an upper water jacket that communicates with the lower water jacket, and is provided on a side away from the cylinder block than the lower water jacket; wherein the lower water jacket includes, for each space between cylinders: a communication flow passage that communicates with the upper water jacket; and a reinforcing post formation part on which a reinforcing post is installed; wherein the reinforcing post formation part is located on a downstream side in a flowing direction of cooling water along a cylinder arrangement direction than the communication flow passage.

19 Claims, 9 Drawing Sheets

WATER JACKET STRUCTURE

CROSS-REFERENCE TO RELATED APPLICATION

This application is based upon and claims the benefit of priority of the prior Japanese Patent Application No. 2018-090770, filed on May 9, 2018, the entire contents of which are incorporated herein by reference.

TECHNICAL FIELD

The present disclosure relates to a water jacket structure.

BACKGROUND

There has been conventionally known a cylinder head with a two-stage flow passage having a lower water jacket into which cooling water flows from a cooling water flow passage of a cylinder block, and an upper water jacket into which the cooling water flows from the lower water jacket (e.g. see Patent Document 1: Japanese Unexamined Patent Application Publication No. 2017-193971).

By the way, when a water jacket formed in the cylinder head is provided, it is required to secure a rigidity to an explosion load and suppress a pressure loss associated with the flow of the cooling water. In the Patent Document 1, there is room for improvement on these points.

SUMMARY

It is an object of the present disclosure to provide a water jacket structure that can secure a rigidity between cylinders to an explosion load and suppress a pressure loss of the cooling water in the cylinder head.

The above object is achieved by a water jacket structure including: a lower water jacket that is provided inside a cylinder head installed at the top of a cylinder block; and an upper water jacket that communicates with the lower water jacket, and is provided on a side away from the cylinder block than the lower water jacket; wherein the lower water jacket includes, for each space between cylinders: a communication flow passage that communicates with the upper water jacket; and a reinforcing post formation part on which a reinforcing post is installed; wherein the reinforcing post formation part is located on a downstream side in a flowing direction of cooling water along a cylinder arrangement direction than the communication flow passage.

The lower water jacket may include a reduced diameter part that prevents the cooling water from passing therethrough, in the vicinity of the reinforcing post formation part. Also, the reinforcing post formation part may be coupled with a thickness part forming an intake port part. Also, the reinforcing post formation part may include a first curved surface on a side facing the communication flow passage, the first curved surface having a recessed shape toward a side away from the communication flow passage. Also, the reinforcing post formation part may include a second curved surface on a back side of a surface facing the communication flow passage, the second curved surface having a bulging shape toward a side away from the communication flow passage.

The reinforcing post formation part may have an end part that is close to an opening part communicating with another water jacket formed in the cylinder block, and is placed to be inclined toward the communication flow passage. Also, a part of the reinforcing post formation part may overlap an inter-cylinder center.

DETAILED DESCRIPTION

Hereinafter, a description will be given of embodiment of the present invention with reference to attached drawings. It should be noted that a size and a ratio of each element do not correspond to the actual ones in some drawings. Also, some elements which exist in fact may be omitted in some drawings.

First, a description will be given of the configuration of a cooling water flow passage of an engine 2 into which a water jacket structure 100 of an embodiment is incorporated with reference to FIGS. 1 to 3.

The engine 2 into which the water jacket structure 100 of the present embodiment is incorporated is a series three-cylinder gasoline engine. However, as long as the engine has a plurality of cylinders arranged in a crankshaft direction, i.e., a region between the cylinders is formed, the number of cylinders is not limited to three cylinders. Moreover, even a so-called V-type engine and a horizontally opposed engine, the engine in which the cylinders are arranged along an axial direction of the crankshaft and the region between the cylinders is formed can incorporate the water jacket structure 100 therein, as in the present embodiment. The engine 2 of the present embodiment is a four-valve engine equipped with two exhaust valves and two intake valves as described in detail later, but the number of exhaust valves and intake valves is not limited thereto. Here, in the following description, as illustrated in FIGS. 2 and 3, a front side and a rear side of the engine 2, and an upstream side and a downstream side of a flowing direction of the cooling water are set, and an intake (IN) side and an exhaust (EX) side are also set. Also, in FIGS. 2 and 3, a thickness part is indicated by hatching.

Figure 1:
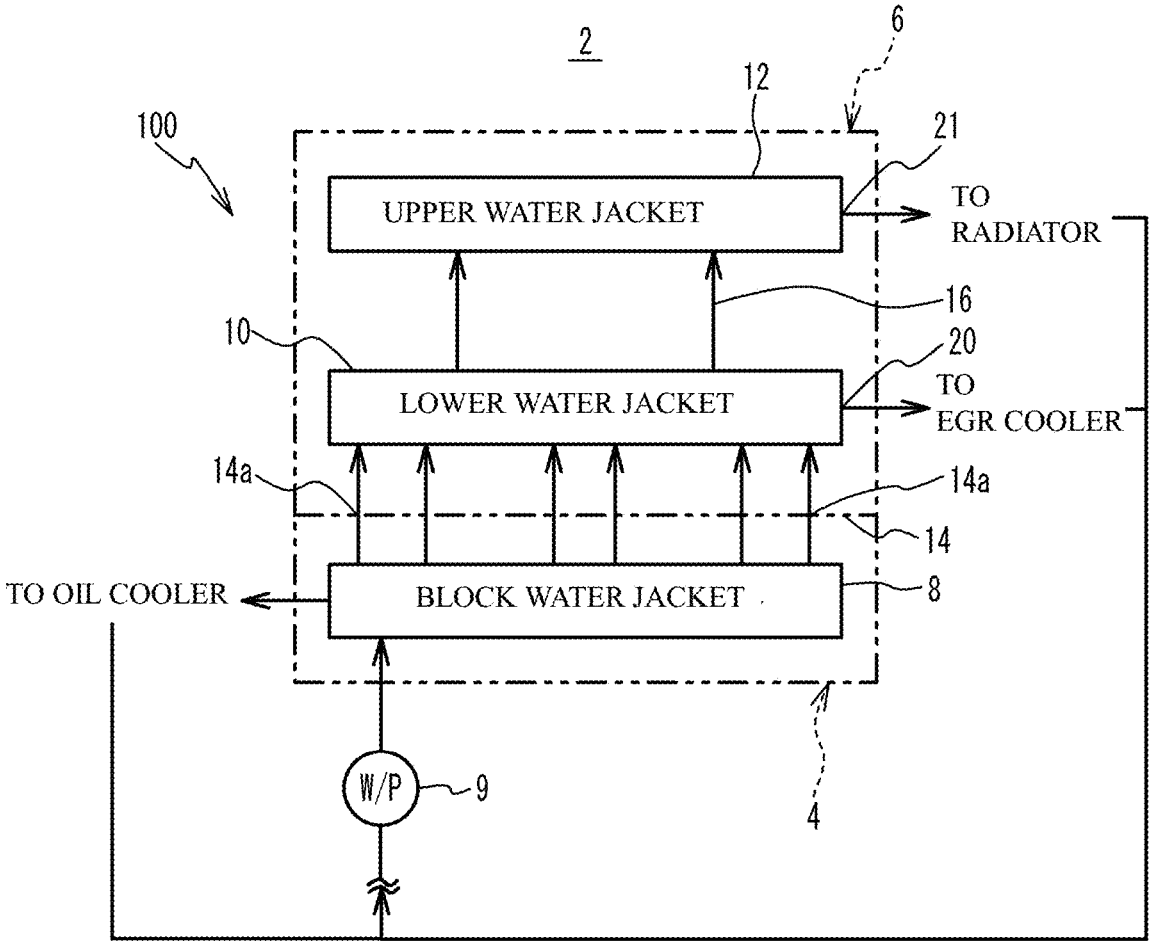
FIG. 1 is a schematic diagram illustrating the configuration of a cooling water flow passage of an engine into which a water jacket structure of an embodiment is incorporated.

Referring to FIG. 1, the engine 2 includes a cylinder block 4 and a cylinder head 6 provided at the top of the cylinder block 4. Both of the cylinder block 4 and the cylinder head 6 are formed of a well-known aluminum material. The cylinder block 4 includes a cylinder wall into which a piston is inserted, and an outer wall surrounding the cylinder wall. A space formed between these walls corresponds to a block water jacket (hereinafter also referred to as "a block W/J") 8 that is a flow passage of the cylinder block 4.

Inside the cylinder head 6, a lower water jacket (hereinafter also referred to as "a lower W/J") 10 and an upper water jacket (hereinafter also referred to as "an upper W/J") 12 are provided in a state of being separated in two upper and lower stages. That is, the water jackets with two stage structure are provided in the cylinder head 6.

The lower water jacket 10 communicates with the block W/J 8 through opening parts 14*a* provided at predetermined positions of a gasket 14 which is inserted between the cylinder block 4 and the cylinder head 6. The upper water jacket 12 communicates with the lower water jacket 10 through communication flow passages 16. The arrangement of the opening parts 14*a* and the communication flow passages 16 will be described in detail later.

The engine 2 includes a water pump (W/P) 9. In the engine 2 of the present embodiment, the W/P 9 is disposed on a front side and an intake side of the engine 2. When the W/P 9 is driven, the cooling water is sent to the block W/J 8. The cooling water flowed into the block W/J 8 is sent to the lower W/J 10 and an oil cooler therefrom. Also, the cooling water flowed into the lower W/J 10 flows to the upper W/J 12 through the communication flow passages 16, and is further sent to an EGR cooler through a discharge port 20 provided at a rear end of the lower W/J 10. Also, the cooling water flowed into the upper W/J 12 is sent to a radiator through a discharge port 21 provided at a rear end of the upper W/J 12. The cooling water flowed into the oil cooler, the EGR cooler and the radiator flows into the W/P 9 again. In this way, the cooling water flows, so that heat exchange is performed between a body of the engine 2, an engine oil, an EGR gas or an outside air, and the cooling water.

Figure 2:
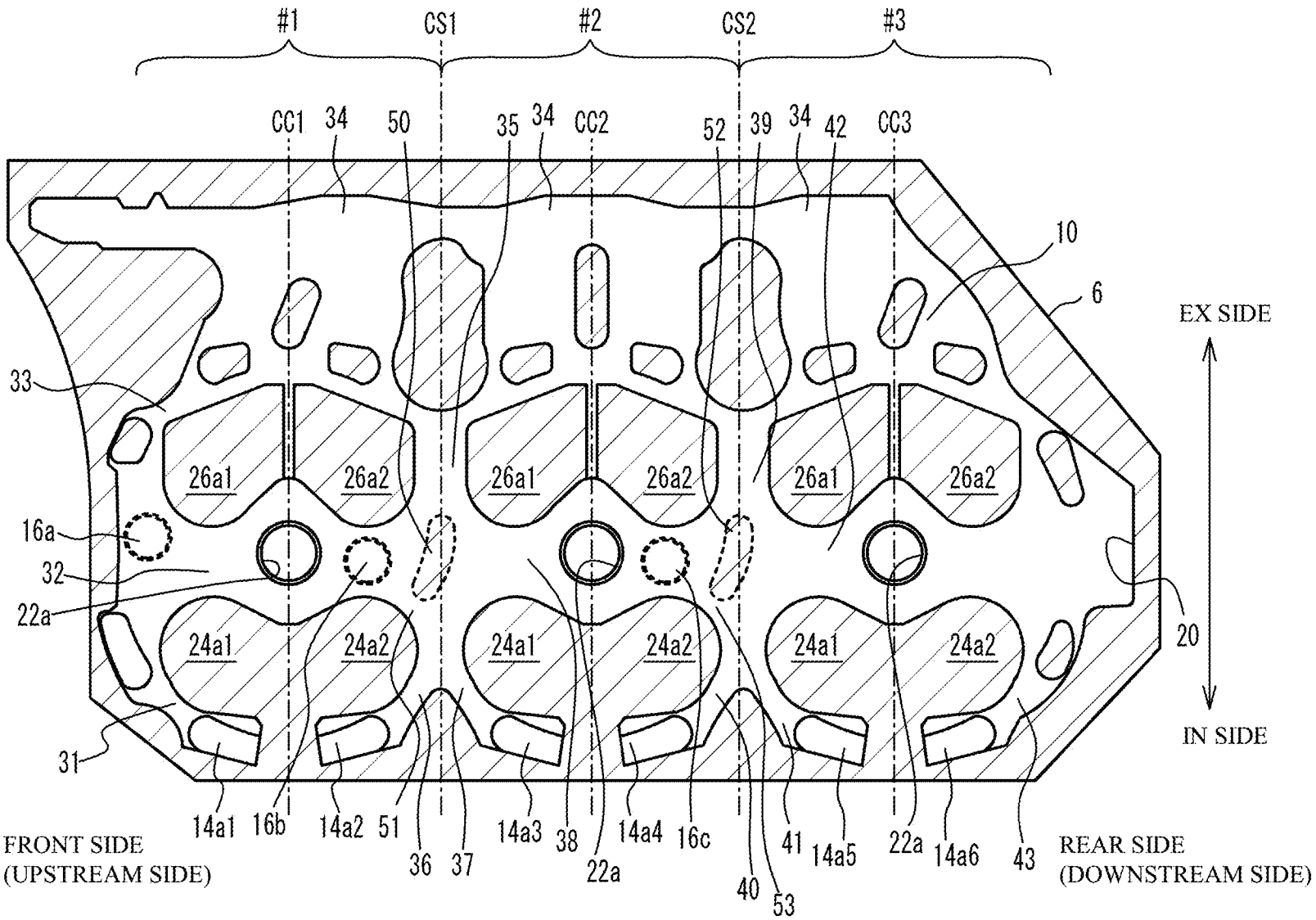
FIG. 2 is a diagram illustrating a lower water jacket that the water jacket structure of the embodiment includes.
Figure 3:
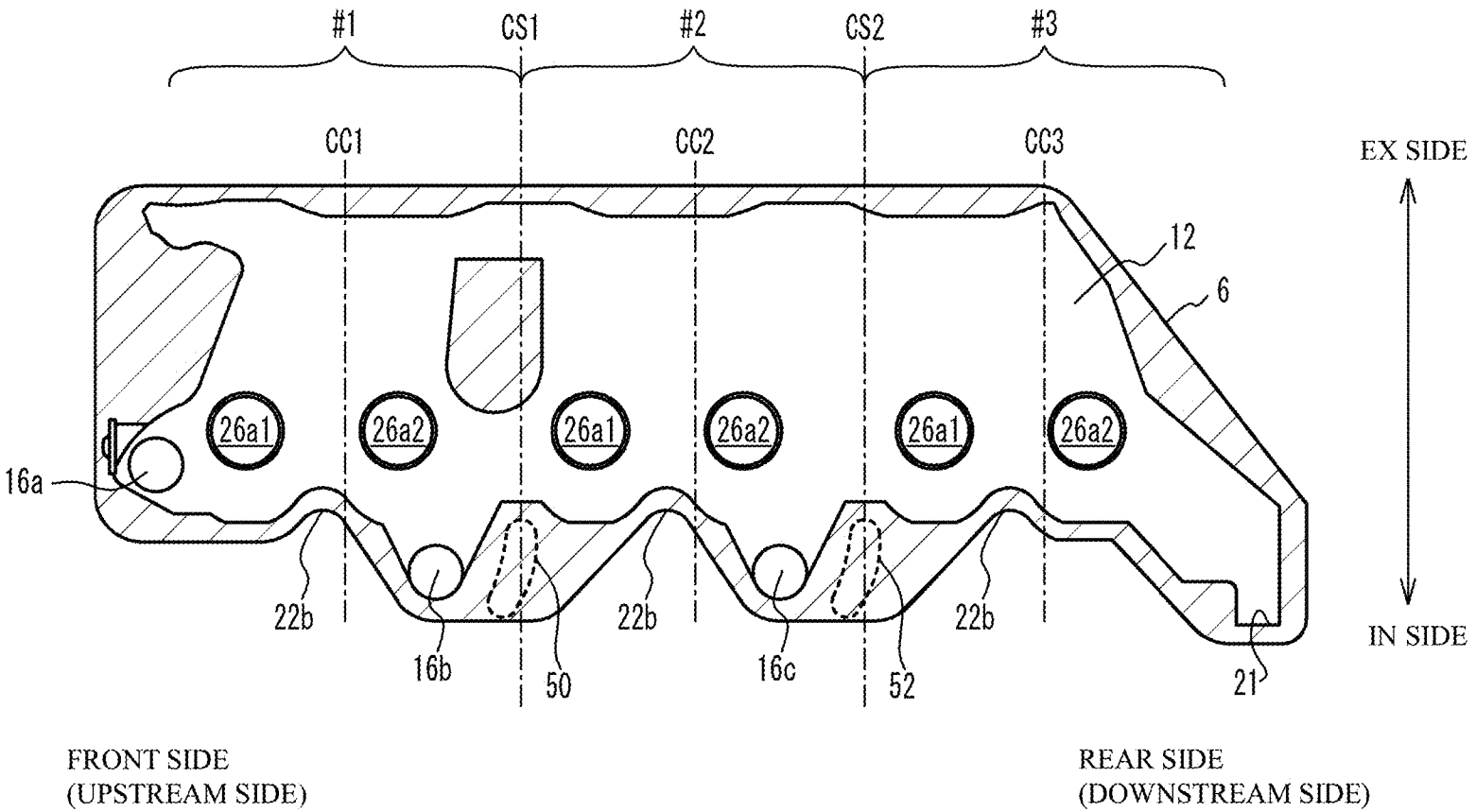
FIG. 3 is a diagram illustrating an upper water jacket that the water jacket structure of the embodiment includes.

Referring to FIG. 2, the lower W/J 10 is provided on a side close to the cylinder block 4 and is provided over the entire region from the intake (IN) side to the exhaust (EX) side, and therefore can effectively cool the periphery of a combustion chamber. The cylinder head 6 can be divided into a first cylinder region #1, a second cylinder region #2 and a third cylinder region #3. Ignition plug holes 22*a* to which ignition plugs are attached are provided on a central part passing through a center line CC1 of the first cylinder region #1, a central part passing through a center line CC2 of the second cylinder region #2, and a central part passing through a center line CC3 of the third cylinder region #3, respectively.

The thickness part is formed around each of the ignition plug holes 22*a* across the flow passage of the lower W/J 10. Specifically, intake port parts 24*a*1 and 24*a*2 are formed on the intake (IN) side from the ignition plug holes 22*a*. Intake valves are reciprocatably mounted in an axial direction into holes provided in the thickness parts forming the intake port parts 24*a*1 and 24*a*2. Since a single intake valve is mounted into each of the intake port parts 24*a*1 and 24*a*2, two intake valves per one cylinder are equipped.

In the cylinder head 6, exhaust port parts 26*a*1 and 26*a*2 are formed on the exhaust (EX) side from the ignition plug holes 22*a*. Exhaust valves are reciprocatably mounted in the axial direction into holes provided in the thickness parts forming the exhaust port parts 26*a*1 and 26*a*2. Since a single exhaust valve is mounted into each of the exhaust port parts 26*a*1 and 26*a*2, two exhaust valves per one cylinder are equipped.

The lower W/J 10 includes a first flow passage 31 on an upstream side from the center line CC1 and on the intake (IN) side in the first cylinder region #1. A first opening part 14*a*1 that is one of the opening parts 14*a* provided on the gasket 14 is located at an end part of the first flow passage 31. The cooling water is introduced into the first flow passage 31 from the block W/J 8 provided in the cylinder block 4 through the first opening part 14*a*1. The first flow passage 31 is branched to a second flow passage 32 and a third flow passage 33 at a front side (i.e., an upstream side) of the ignition plug hole 22*a* provided in the first cylinder region #1. The second flow passage 32 passes through the periphery of the ignition plug hole 22*a* to extend toward the second cylinder region #2. The third flow passage 33 passes through the front side (i.e., the upstream side) of the exhaust port part 26*a*2 to extend to the exhaust (EX) side, and is connected to a fourth flow passage 34 provided on the exhaust (EX) side. Here, the fourth flow passage 34 extends over the entire region from the first cylinder region #1 to the third cylinder region #3.

A fifth flow passage 35 is provided between the first cylinder region #1 and the second cylinder region #2 so as to pass through an inter-cylinder center CS1. The fifth flow passage 35 is connected to the second flow passage 32 and the fourth flow passage 34.

The lower W/J 10 includes a sixth flow passage 36 on the downstream side from the center line CC1 and on the intake (IN) side in the first cylinder region #1. A second opening part 14*a*2 that is one of the opening parts 14*a* provided on the gasket 14 is located at an end part of the sixth flow passage 36. The cooling water is introduced into the sixth flow passage 36 from the block W/J 8 provided in the cylinder block 4 through the second opening part 14*a*2.

The lower W/J 10 includes a seventh flow passage 37 on the upstream side from the center line CC2 and on the intake (IN) side in the second cylinder region #2. A third opening part 14*a*3 that is one of the opening parts 14*a* provided on the gasket 14 is located at an end part of the seventh flow passage 37. The cooling water is introduced into the seventh flow passage 37 from the block W/J 8 provided in the cylinder block 4 through the third opening part 14*a*3. The seventh flow passage 37 is branched to an eighth flow passage 38 and the fifth flow passage 35 at the front side (i.e., the upstream side) of the ignition plug hole 22*a* provided in the second cylinder region #2. The eighth flow passage 38 passes through the periphery of the ignition plug hole 22*a* to extend toward the third cylinder region #3.

A ninth flow passage 39 is provided between the second cylinder region #2 and the third cylinder region #3 so as to pass through an inter-cylinder center CS2. The ninth flow passage 39 is connected to the eighth flow passage 38 and the fourth flow passage 34.

The lower W/J 10 includes a tenth flow passage 40 on the downstream side from the center line CC2 and on the intake (IN) side in the second cylinder region #2. A fourth opening part 14*a*4 that is one of the opening parts 14*a* provided on the gasket 14 is located at an end part of the tenth flow passage 40. The cooling water is introduced into the tenth flow passage 40 from the block W/J 8 provided in the cylinder block 4 through the fourth opening part 14*a*4.

The lower W/J 10 includes an eleventh flow passage 41 on the upstream side from the center line CC3 and on the intake (IN) side in the third cylinder region #3. A fifth opening part 14*a*5 that is one of the opening parts 14*a* provided on the gasket 14 is located at an end part of the eleventh flow passage 41. The cooling water is introduced into the eleventh flow passage 41 from the block W/J 8 provided in the cylinder block 4 through the fifth opening part 14*a*5. The eleventh flow passage 41 is branched to a twelfth flow passage 42 and the ninth flow passage 39 at the front side (i.e., the upstream side) of the ignition plug hole 22*a* provided in the third cylinder region #3. The twelfth flow passage 42 passes through the periphery of the ignition plug hole 22*a* to extend toward a rear end part of the cylinder head 6.

The lower W/J 10 includes a thirteenth flow passage 43 on the downstream side from the center line CC3 and on the intake (IN) side in the third cylinder region #3. A sixth opening part 14*a*6 that is one of the opening parts 14*a* provided on the gasket 14 is located at an end part of the thirteenth flow passage 43. The cooling water is introduced into the thirteenth flow passage 43 from the block W/J 8 provided in the cylinder block 4 through the sixth opening part 14*a*6.

On the other hand, the upper W/J 12 communicating with the lower W/J 10 through the communication flow passages 16 is provided on a side away from the cylinder block 4 than the lower W/J 10. That is, the upper W/J 12 is provided on an opposite side of the cylinder block 4 across the lower W/J 10. The upper W/J 12 includes notch parts 22*b* on an end edge of the intake (IN) side, as illustrated in FIG. 3. The notch parts 22*b* are provided so as not to interfere with the ignition plugs depending on the arrangement of the ignition plug holes 22*a*. The exhaust (EX) port parts 26*a*1 and 26*a*2 are extended to the upper W/J 12. In this way, the upper W/J 12 is provided so as to be offset to the exhaust (EX) side. The upper W/J 12 has a large flow passage diameter and a low pressure loss, compared with the lower W/J 10.

Referring again to FIG. 2, the lower W/J 10 includes, between the cylinders, communication flow passages 16*b* and 16*c* that communicates with the upper W/J 12, and reinforcing post formation parts 50 and 52 in which reinforcing posts are installed. Here, with respect to the term "between the cylinders", a term "between the first cylinder region #1 and the second cylinder region #2" indicates a term "between the center line CC1 of the first cylinder region #1 and the central line CC2 of the second cylinder region #2". Similarly, a term "between the second cylinder region #2 and the third cylinder region #3" indicates a term "between the center line CC2 of the second cylinder region #2 and the central line CC3 of the third cylinder region #3".

A second communication flow passage 16*b* and a first reinforcing post formation part 50 are provided between the first cylinder region #1 and the second cylinder region #2. The first reinforcing post formation part 50 is provided in the fifth flow passage 35 so as to overlap the inter-cylinder center CS1. Thus, it is possible to separate the cooling water flowing through a first cylinder region #1 side and the cooling water flowing through a second cylinder region #2 side. On the other hand, the second communication flow passage 16*b* is provided on the downstream side than the ignition plug hole 22*a* of the second flow passage 32 which is located on the upstream side than the fifth flow passage 35. In other words, the second communication flow passage 16*b* is disposed between the center line CC1 of the first cylinder region #1 and the inter-cylinder center CS1.

Here, in view of a positional relationship between the first reinforcing post formation part 50 and the second communication flow passage 16*b*, the first reinforcing post formation part 50 is located on the downstream side in the flowing direction of the cooling water along a cylinder arrangement direction than the second communication flow passage 16*b*. In the present embodiment, the second communication flow passage 16*b* is disposed on the front side, and the first reinforcing post formation part 50 is disposed on the rear side thereof. By arranging them in this way, the cooling water easily flows into the upper W/J 12 through the second communication flow passage 16*b*.

That is, the cooling water introduced from the first opening part 14*a*1 flows through the first flow passage 31 and the second flow passage 32, and flows into the upper W/J 12 through the second communication flow passage 16*b* provided on the upstream side of the first reinforcing post formation part 50.

Here, a description will be given of the reinforcing post provided in the first reinforcing post formation part 50. As a part of the cylinder head 6, the reinforcing post is formed of an aluminum material forming the cylinder head 6. The reinforcing post couples the thickness part forming the lower W/J 10 and the thickness part forming the upper W/J 12 with each other. Thus, the strength of the cylinder head 6 is improved, and the rigidity to the explosion load is increased. The reinforcing post has functions not only to improve the strength of the cylinder head 6, also to control the flow of the cooling water. Specifically, the cooling water flowing through the sixth flow passage 36 and the cooling water flowing through the seventh flow passage 37 are flowed to the second cylinder region #2 side. That is, the reinforcing post to be provided in the first reinforcing post formation part 50 is provided so as to flow the cooling water to the rear side thereof.

Figure 4:
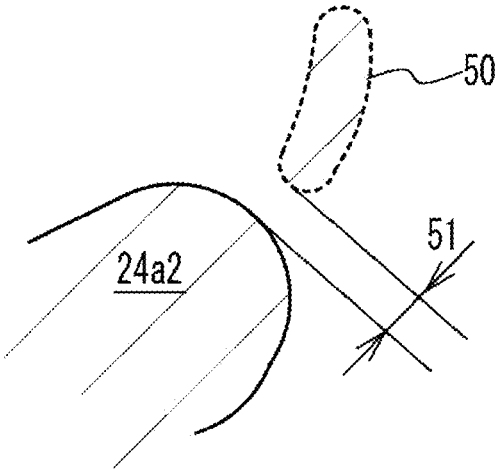
FIG. 4 is a diagram illustrating an enlarged periphery of a first reduced diameter part.

As enlarged and illustrated in FIG. 4, the lower W/J 10 includes a first reduced diameter part 51 that prevents the cooling water from passing therethrough, in the vicinity of the first reinforcing post formation part 50. By narrowing the flow passage diameter, the first reduced diameter part 51 is in a state of hardly passing through the cooling water. In the present embodiment, the first reduced diameter part 51 is provided in the vicinity of the first reinforcing post formation part 50, specifically, between the first reinforcing post formation part 50 and the intake port parts 24*a*2. Although the first reduced diameter part 51 is connected to the sixth flow passage 36, the first reduced diameter part 51 has a narrowed flow passage diameter as compared with the surrounding, and is in the state of hardly passing through the cooling water. Therefore, the cooling water flowing through the sixth flow passage 36 is prevented from flowing into the first reduced diameter part 51, and flowing the cooling water from the sixth flow passage 36 to the second flow passage 32 is suppressed. When the flow of the cooling water is suppressed in this way, it is possible to reduce the pressure loss.

A third communication flow passage 16*c* and a second reinforcing post formation part 52 are provided between the second cylinder region #2 and the third cylinder region #3. The second reinforcing post formation part 52 is provided in the ninth flow passage 39 so as to overlap the inter-cylinder center CS2. Thus, it is possible to separate the cooling water flowing through the second cylinder region #2 side and the cooling water flowing through a third cylinder region #3 side. On the other hand, the third communication flow passage 16*c* is provided on the downstream side than the ignition plug hole 22*a* of the eighth flow passage 38 which is located on the upstream side than the ninth flow passage 39. In other words, the third communication flow passage 16*c* is disposed between the center line CC2 of the second cylinder region #2 and the inter-cylinder center CS2.

Here, in view of a positional relationship between the second reinforcing post formation part 52 and the third communication flow passage 16*c*, the second reinforcing post formation part 52 is located on the downstream side in the flowing direction of the cooling water along the cylinder arrangement direction than the third communication flow passage 16*c*. By arranging them in this way, the cooling water easily flows into the upper W/J 12 through the third communication flow passage 16*c*.

That is, the cooling water introduced from the third opening part 14*a*3 flows through the seventh flow passage 37 and the eighth flow passage 38, and flows into the upper W/J 12 through the third communication flow passage 16*c* provided on the upstream side of the second reinforcing post formation part 52.

Here, as with the reinforcing post provided in the first reinforcing post formation part 50, the reinforcing post provided in the second reinforcing post formation part 52 is formed of an aluminum material forming the cylinder head 6, as a part of the cylinder head 6. The reinforcing post couples the thickness part forming the lower W/J 10 and the thickness part forming the upper W/J 12 with each other. Thus, the strength of the cylinder head 6 is improved, and the rigidity to the explosion load is increased. The reinforcing post has functions not only to improve the strength of the cylinder head 6, also to control the flow of the cooling water. Specifically, the cooling water flowing through the tenth flow passage 40 and the cooling water flowing through the eleventh flow passage 41 are flowed to the third cylinder region #3 side. That is, the reinforcing post to be provided in the second reinforcing post formation part 52 is provided so as to flow the cooling water to the rear side thereof.

The lower W/J 10 includes a second reduced diameter part 53 in the vicinity of the second reinforcing post formation part 52. Since the configuration of the second reduced diameter part 53 is common to that of the first reduced diameter part 51, a detailed description thereof will be omitted.

Figure 5:
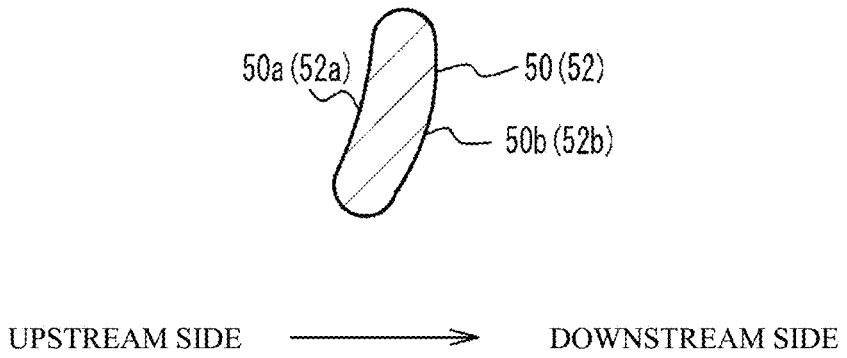
FIG. 5 is a diagram illustrating a reinforcing post formation part.

Here, a description will be given of the shape of the reinforcing post formation parts 50 and 52 with reference to FIG. 5. Since the configuration of the reinforcing post formation parts 50 and 52 is common to each other, a description will be given of the reinforcing post formation part 50. The first reinforcing post formation part 50 includes a first curved surface 50*a* on a side facing the second communication flow passage 16*b*, between the first cylinder region #1 and the second cylinder region #2. The first curved surface 50*a* has a recessed shape toward a side away from the second communication flow passage 16*b*. By providing such a first curved surface 50*a*, the cooling water is easily introduced to the second communication flow passage 16*b*.

Moreover, the first reinforcing post formation part 50 includes a second curved surface 50*b* on a back side of the surface (i.e., the first curved surface 50*a*) facing the second communication flow passage 16*b*, between the first cylinder region #1 and the second cylinder region #2. The second curved surface 50*b* has a bulging shape toward a side away from the second communication flow passage 16*b*. By providing the second curved surface 50*b*, the first reinforcing post formation part 50 has an end part that is close to the second opening part 14*a*2 and the third opening part 14*a*3 communicating with the block W/J 8, and is placed to be inclined toward the upstream side in the flowing direction of the cooling water along the cylinder arrangement direction. With such an arrangement, the cooling water flowed from the second opening part 14*a*2 and the third opening part 14*a*3 is easily flowed to the rear side of the reinforcing post provided in the first reinforcing post formation part 50. As a result, in the second cylinder region #2, the cooling water flowed from the second opening part 14*a*2 and the third opening part 14*a*3 is in a state of the so-called vertical flow easily. Here, in the present embodiment, the "vertical flow" means flowing the cooling water in a direction along an axial direction of a crank shaft.

Since the second reinforcing post formation part 52 also has the same configuration as the first reinforcing post formation part 50, the cooling water flowed from the fourth opening part 14*a*4 and the fifth opening part 14*a*5 can be easily flowed to the rear side of the reinforcing post provided in the second reinforcing post formation part 52. As a result, in the third cylinder region #3, the cooling water flowed from the fourth opening part 14*a*4 and the fifth opening part 14*a*5 is in the state of the so-called vertical flow easily.

Here, a first communication flow passage 16*a* is provided on an end part in the front side of the lower W/J 10. The cooling water is introduced from the lower W/J 10 to the upper W/J 12 also through the first communication flow passage 16*a*. Further, a discharge port 20 is provided on a rear end part of the lower W/J 10. The cooling water discharged from the discharge port 20 is sent to the EGR cooler.

The first communication flow passage 16*a*, the second communication flow passage 16*b* and the third communication flow passage 16*c* can be provided by drilling. The first communication flow passage 16*a*, the second communication flow passage 16*b* and the third communication flow passage 16*c* are sealed by fitting plugs from an upper surface side.

Thus, the water jacket structure 100 of the present embodiment can be achieve the vertical flow for each cylinder.

Figure 6:
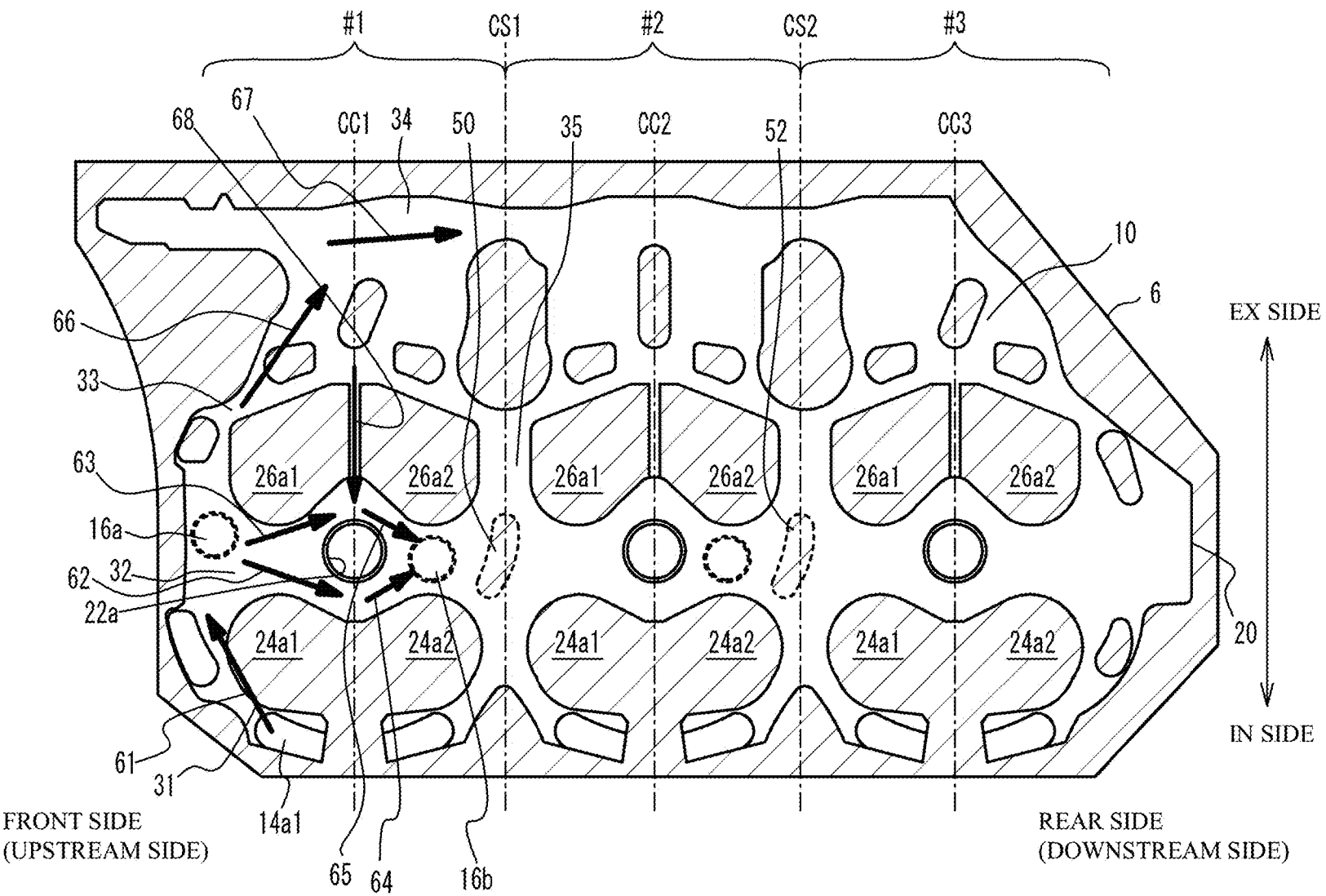
FIG. 6 is a diagram illustrating the flow of cooling water in a first cylinder region #1.

That is, in the first cylinder region #1 of FIG. 6, the cooling water flowed from the first opening part 14*a*1 as indicated by an arrow 61 flows into the second flow passage 32 as indicated by arrows 62 and 63 via the first flow passage 31. Then, the cooling water passes through the surrounding of the ignition plug hole 22*a* as indicated by arrows 64 and 65, i.e., passes between the intake port parts 24*a*1 and 24*a*2 and the exhaust port parts 26*a*1 and 26*a*2. In this way, the cooling water in which the vertical flow has been performed flows into the upper W/J 12 with the low pressure loss via the second communication flow passage 16*b*. Here, the flow of the cooling water also includes the flow toward the third flow passage 33 and the fourth flow passage 34 as indicated by arrows 66 and 67, and the flow passing between the exhaust port parts 26*a*1 and 26*a*2 as indicated by an arrow 68.

Figure 7:
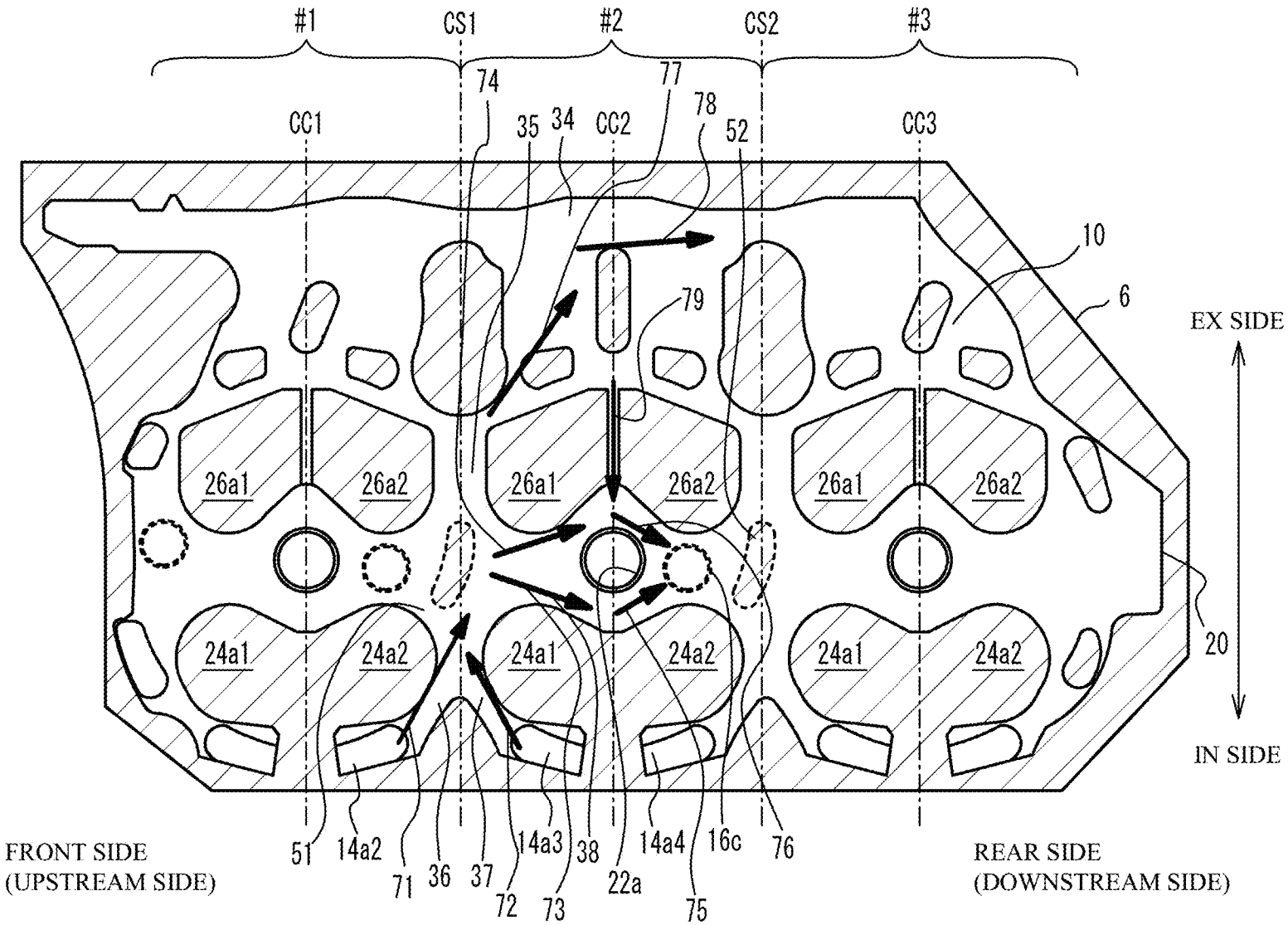
FIG. 7 is a diagram illustrating the flow of the cooling water in a second cylinder region #2.

In the second cylinder region #2 of FIG. 7, the cooling water flowed from the second opening part 14*a*2 as indicated by an arrow 71 flows into the eighth flow passage 38 as indicated by arrows 73 and 74 via the sixth flow passage 36. Also, the cooling water flowed from the third opening part 14*a*3 as indicated by an arrow 72 flows into the eighth flow passage 38 as indicated by arrows 73 and 74 via the seventh flow passage 37. Then, the cooling water passes through the surrounding of the ignition plug hole 22*a* as indicated by arrows 75 and 76, i.e., passes between the intake port parts 24*a*1 and 24*a*2 and the exhaust port parts 26*a*1 and 26*a*2. In this way, the cooling water in which the vertical flow has been performed flows into the upper W/J 12 with the low pressure loss via the third communication flow passage 16*c*. Here, the flow of the cooling water also includes the flow toward the fifth flow passage 35 and the fourth flow passage 34 as indicated by arrows 77 and 78, and the flow passing between the exhaust port parts 26*a*1 and 26*a*2 as indicated by an arrow 79.

Figure 8:
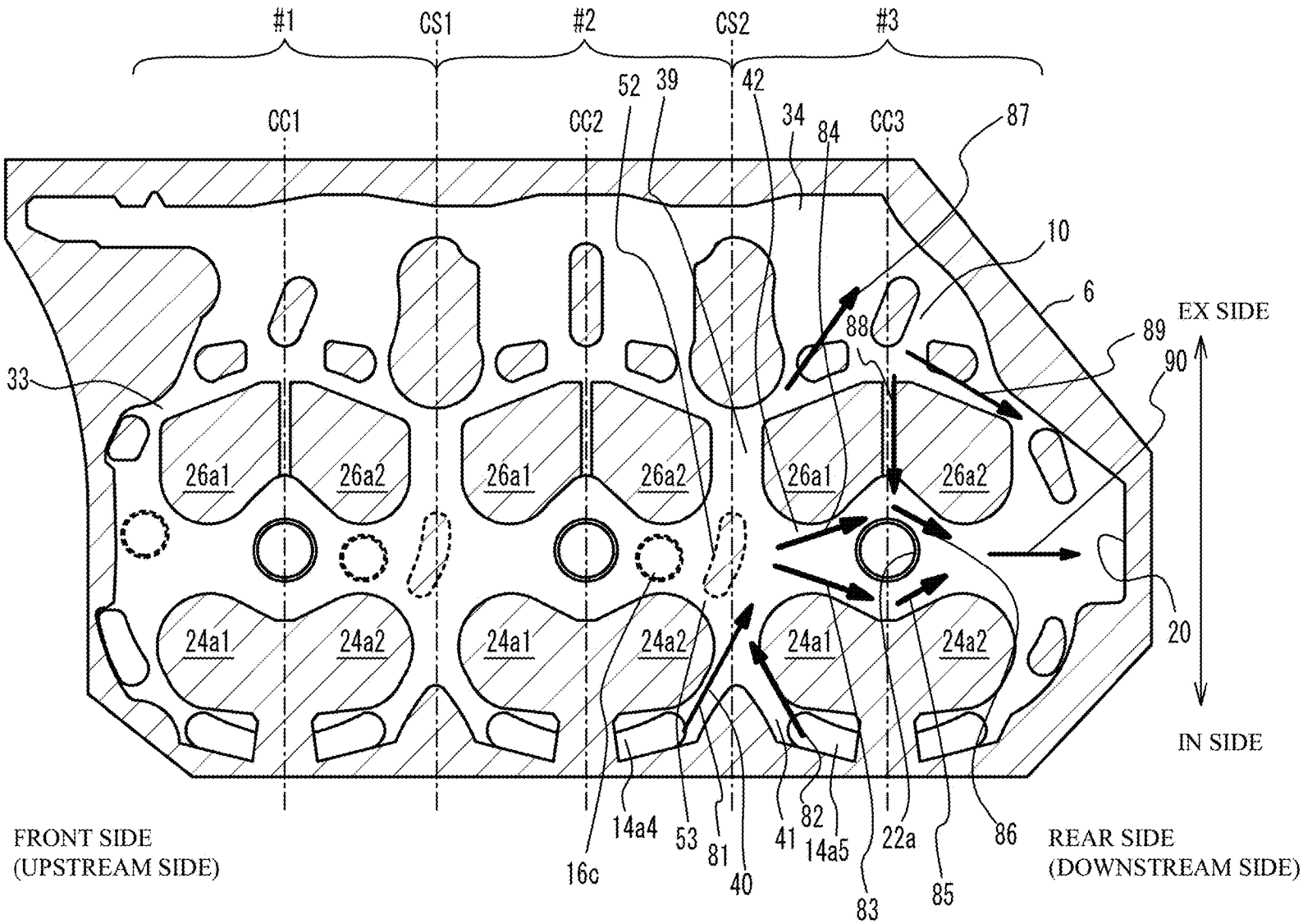
FIG. 8 is a diagram illustrating the flow of the cooling water in a third cylinder region #3.

In the cylinder located at a rearmost end, i.e., in the third cylinder region #3 of the present embodiment of FIG. 8, the cooling water flowed from the fourth opening part 14*a*4 as indicated by an arrow 81 flows into the twelfth flow passage 42 as indicated by arrows 83 and 84 via the tenth flow passage 40. Also, the cooling water flowed from the fifth opening part 14*a*5 as indicated by an arrow 82 flows into the twelfth flow passage 42 as indicated by arrows 83 and 84 via the eleventh flow passage 41. Then, the cooling water passes through the surrounding of the ignition plug hole 22*a* as indicated by arrows 85 and 86, i.e., passes between the intake port parts 24*a*1 and 24*a*2 and the exhaust port parts 26*a*1 and 26*a*2. In the third cylinder region #3 located at the rearmost end, the cooling water in which the vertical flow has been performed is discharged from the discharge port 20 as it is. Here, the flow of the cooling water also includes the flow toward the ninth flow passage 39 as indicated by an arrow 87, and the flow passing between the exhaust port parts 26*a*1 and 26*a*2 as indicated by an arrow 88. Moreover, the flow of the cooling water includes the flow toward the discharge port 20 as indicated by arrows 89 and 90.

According to the water jacket structure 100 of the present embodiment, the water jacket structure 100 can include the reinforcing posts, and therefore a rigidity between the cylinders to an explosion load is secured. Also, the vertical flow for each cylinder is achieved by the positional relationship between the reinforcing post, and the communication flow passage communicating the lower W/J 10 and the upper W/J 12. In the vertical flow for each cylinder according to the present embodiment, the cooling water flows into the upper W/J 12 with the low pressure loss via the second communication flow passage 16*b* and the third communication flow passage 16*c*, and therefore the pressure loss is reduced and a cooling effect is increased. In addition, in this embodiment, since the distance of the vertical flow is short, the pressure loss is further reduced and the cooling effect is further increased.

Figure 9:
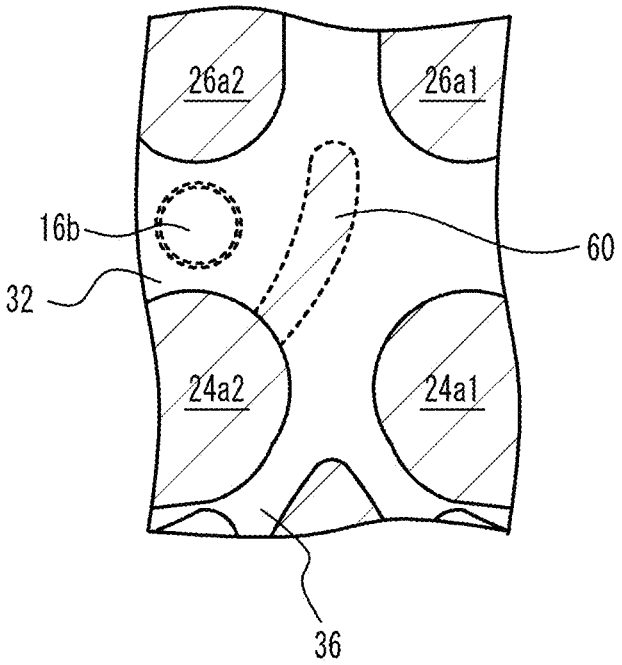
FIG. 9 is a diagram illustrating an periphery of the reinforcing post formation part in another embodiment.

Next, a description will be given of a variation with reference to FIG. 9. In an example illustrated in FIG. 9, a first reinforcing post formation part 60 is provided instead of the first reinforcing post formation part 50. In the first reinforcing post formation part 50 illustrated in FIG. 5, the flow passages of the cooling water are formed therearound, and the first reduced diameter part 51 is provided between the first reinforcing post formation part 50 and the intake port part 24*a*2. On the other hand, the first reinforcing post formation part 60 is coupled with a thickness part forming the intake port part 24*a*2. That is, the first reinforcing post formation part 60 does not include the first reduced diameter part 51. Thus, in the embodiment not having the first reduced diameter part 51, since the second flow passage 32 and the sixth flow passage 36 are divided, the cooling water cannot flow from the sixth flow passage 36 to the second flow passage 32. As a result, the pressure loss is reduced, and the efficiency of the vertical flow for each cylinder is improved, thus, the cooling efficiency is improved. Here, the second reinforcing post formation part 52 may be also configured to be coupled with the intake port part 24*a*2 as well.

The above-described embodiments are just examples for carrying out the invention. The present invention is not limited to those but it is apparent from the above description that the above embodiments are varied variously within the scope of the present invention and that other various embodiments may be made within the scope of the present invention.

What is claimed is:

1. A water jacket structure comprising:

a lower water jacket that is provided inside a cylinder head installed at the top of a cylinder block;

a discharge port for discharging cooling water provided on a rear end part of the lower water jacket; and an upper water jacket that communicates with the lower water jacket, and is provided on a side away from the cylinder block than the lower water jacket;

wherein the lower water jacket includes, for each space between cylinders:

a communication flow passage that communicates with the upper water jacket; and a reinforcing post formation part on which a reinforcing post is installed;

wherein, in each space between the cylinders, the reinforcing post formation part is located on a downstream side in a flowing direction of cooling water along a cylinder arrangement direction than the communication flow passage;

wherein the discharge port is located on the further downstream in the flowing direction of cooling water along the cylinder arrangement direction than the reinforcing post formation parts.

2. The water jacket structure as claimed in claim 1, wherein the lower water jacket includes a reduced diameter part that prevents the cooling water from passing therethrough, in the vicinity of the reinforcing post formation part.

3. The water jacket structure as claimed in claim 1, wherein the reinforcing post formation part is coupled with a thickness part forming an intake port part.

4. The water jacket structure as claimed in claim 1, wherein the reinforcing post formation part includes a first curved surface on a side facing the communication flow passage, the first curved surface having a recessed shape toward a side away from the communication flow passage.

5. The water jacket structure as claimed in claim 1, wherein the reinforcing post formation part includes a second curved surface on a back side of a surface facing the communication flow passage, the second curved surface having a bulging shape toward a side away from the communication flow passage.

6. The water jacket structure as claimed in claim 1, wherein the reinforcing post formation part has an end part that is close to an opening part communicating with another water jacket formed in the cylinder block, and is placed to be inclined toward the communication flow passage.

7. The water jacket structure as claimed in claim 1, wherein a part of the reinforcing post formation part overlaps an inter-cylinder center.

8. An engine comprising:

a cylinder block comprising a first cylinder and a second cylinder;

a cylinder head over the cylinder block, wherein the first cylinder defines a first cylinder region in the cylinder head above the first cylinder, the second cylinder defines a second cylinder region in the cylinder head above the second cylinder, the cylinder head comprises a water jacket structure, and the water jacket structure comprises:

an upper water jacket; and a lower water jacket, wherein the lower water jacket is between the upper water jacket and the cylinder block, and the lower water jacket comprises a communication flow passage in fluid communication with the upper water jacket; and a reinforcing post, wherein the reinforcing post extends from the first cylinder region to the second cylinder region, a first side of the reinforcing post closer to the first cylinder region is concave, a second side of the reinforcing post closer to the second cylinder region is convex, and the first side is opposite the second side.

9. The engine as claimed in claim 8, wherein the reinforcing post is separated from the communication flow passage.

10. The engine as claimed in claim 8, wherein the cylinder head further comprises:

a first intake port in communication with the first cylinder; and a second intake port in communication with the second cylinder, wherein the reinforcing post is spaced from at least one of the first intake port or the second intake port.

11. The engine as claimed in claim 10, wherein the reinforcing post is spaced from each of the first intake port and the second intake port.

12. The engine as claimed in claim 10, wherein the reinforcing post is attached to the first intake port.

13. The engine as claimed in claim 8, wherein cylinder block further comprises a block water jacket, and the lower water jacket further comprises:

a first opening part in the first cylinder region, wherein the first opening part is configured to receive a fluid from the block water jacket; and a second opening part in the firs cylinder region, wherein the second opening part is configured to receive the fluid from the block water jacket.

14. The engine as claimed in claim 13, wherein the cylinder head further comprises a first intake port in communication with the first cylinder separates the first opening part from the second opening part.

15. The engine as claimed in claim 8, wherein the cylinder block further comprises a third cylinder, the third cylinder defines a third cylinder region in the cylinder head over the third cylinder, and the lower water jacket further comprises a second reinforcing post extending from the second cylinder region to the third cylinder region.

16. The engine as claimed in claim 15, wherein a shape of the reinforcing post is a same shape as the second reinforcing post.

17. The engine as claimed in claim 15, wherein a shape of the reinforcing post is different from a shape of the second reinforcing post.

18. A vehicle comprising:

an engine, wherein the engine comprises:

a cylinder block comprising a first cylinder and a second cylinder;

a cylinder head over the cylinder block, wherein the first cylinder defines a first cylinder region in the cylinder head above the first cylinder, the second cylinder defines a second cylinder region in the cylinder head above the second cylinder, the cylinder head comprises a water jacket structure, and the water jacket structure comprises:

an upper water jacket; and a lower water jacket, wherein the lower water jacket is between the upper water jacket and the cylinder block, and the lower water jacket comprises a communication flow passage in fluid communication with the upper water jacket; and a reinforcing post, wherein the reinforcing post is spaced from the communication flow passage, the reinforcing post extends from the first cylinder region to the second cylinder region, a first side of the reinforcing post closer to the first cylinder region is concave, a second side of the reinforcing post closer to the second cylinder region is convex, and the first side is opposite the second side.

19. The vehicle as claimed in claim 18, wherein the cylinder head further comprises:

a first intake port in communication with the first cylinder; and a second intake port in communication with the second cylinder, wherein the reinforcing post is spaced from at least one of the first intake port or the second intake port.

* * * * *